US012066191B2

(12) United States Patent
Simon et al.

(10) Patent No.: US 12,066,191 B2
(45) Date of Patent: Aug. 20, 2024

(54) PELLET HEATER

(71) Applicant: Halo Products Group, LLC, Elizabethtown, KY (US)

(72) Inventors: Paul J. Simon, Elizabethtown, KY (US); Michael R. Giebel, Joplin, MO (US); Xianjia Fan, Zhongshan (CN)

(73) Assignee: WH PRODUCTS, LLC, Columbus, OH (US)

( * ) Notice: Subject to any disclaimer, the term of this patent is extended or adjusted under 35 U.S.C. 154(b) by 0 days.

(21) Appl. No.: 18/200,503

(22) Filed: May 22, 2023

(65) Prior Publication Data

US 2023/0288071 A1 Sep. 14, 2023

Related U.S. Application Data

(63) Continuation of application No. 17/738,734, filed on May 6, 2022, now Pat. No. 11,655,982, which is a continuation-in-part of application No. 17/694,097, filed on Mar. 14, 2022, now Pat. No. 11,703,228, and a continuation-in-part of application No. 17/683,152, filed on Feb. 28, 2022, now Pat. No. 11,553,818.

(60) Provisional application No. 63/185,189, filed on May 6, 2021.

(51) Int. Cl.

| | |
|---|---|
| ***F24B 13/04*** | (2006.01) |
| ***F24B 1/08*** | (2021.01) |
| ***F24B 5/02*** | (2006.01) |

(52) U.S. Cl.

CPC ..... *F24B 13/04* (2013.01); *F24B 1/08* (2013.01); *F24B 5/023* (2013.01)

(58) Field of Classification Search

CPC .. F24B 13/02; F24B 13/04; F24B 1/02; F24B 1/024; F24B 1/028; F24B 1/08; F24B 1/16; F24B 1/18; F24B 1/181; F24B 1/182; F24B 1/183; F24B 1/192; F24B 1/195; F24B 1/197; F24B 1/199; F24B 1/26; F24B 5/021; F24B 5/023; F24B 5/026; F24B 5/028

See application file for complete search history.

(56) References Cited

U.S. PATENT DOCUMENTS

| | | | | |
|---|---|---|---|---|
| 4,619,209 A * | 10/1986 | Traeger | F23B 1/30 | 110/110 |
| 5,285,738 A * | 2/1994 | Cullen | F24B 7/025 | 110/297 |
| 2002/0083944 A1* | 7/2002 | Darbonne, Sr. | F23B 1/38 | 126/501 |
| 2009/0293860 A1* | 12/2009 | Carlson | F24B 13/04 | 126/516 |

FOREIGN PATENT DOCUMENTS

| | | | |
|---|---|---|---|
| EP | 3163162 A1 * | 5/2017 | F23B 20/00 |

* cited by examiner

*Primary Examiner* — Hung D Nguyen
(74) *Attorney, Agent, or Firm* — David R Yohannan

(57) ABSTRACT

A solid pellet fueled heater having a base unit with forced air blowers and a dual tube chimney structure is disclosed. The dual tube chimney structure may be used to warm incoming air for distribution around the heater. The pellet heater may also include a dual auger system and multi/high speed auger motor. The dual auger may include first and second auger blades mounted on a single auger shaft having blade pitches configured to convey solid fuel in opposite directions.

19 Claims, 9 Drawing Sheets

PELLET HEATER

CROSS-REFERENCE TO RELATED APPLICATIONS

This application is a continuation, and claims the benefit, of U.S. Nonprovisional application Ser. No. 17/738,734 filed May 6, 2022, the disclosure of which is hereby incorporated by reference herein in its entirety.

FIELD OF THE INVENTION

Embodiments of the present invention relate to outdoor heating appliances.

BACKGROUND OF THE INVENTION

Outdoor socializing has become increasingly popular even when the weather is cool or cold. As a result, families may utilize outdoor heating appliances to keep their outdoor entertaining area warm. A number of different appliances are currently available to heat outdoor spaces. Such appliances require some form of power and/or fuel to generate the heat required, or in some instances to power systems used to ignite and control the combustion of a given fuel. Over the years, the most popular power/fuel source has varied. Historically, popular heat/fuel sources have included electrical heating elements, wood logs and chips, charcoal briquettes, propane gas, natural gas, and more recently biomass pellets. References herein to a "pellet heater" are intended to include all devices that use some form of pelletized (i.e., solid) fuel, whether or not such fuel is technically considered biomass fuel.

Biomass pellets have several advantages over other fuel sources for outdoor heating. For one, biomass pellets are relatively easy and safe to transport and store. As compared with charcoal or wood, biomass pellets are also capable of providing a controlled burn rate and level of heat. Still further, biomass pellets may be manufactured to provide a particular "flavor" to the exhaust fumes as a result of combusting a pellet including a particular wood type. For example, a consumer may select hickory, maple, or cherry pellets, or a combination of pellet flavors, to impart a desired fragrance to the exhaust fumes.

Existing pellet heaters, however, do have some disadvantages as currently designed. For example, existing pellet heaters typically require a continuous supply of alternating current (AC) power limiting the use of the heater to locations with such power supplies and requiring unsightly power cords. Thus, there is a need for a pellet heater that is untethered to a continuous supply of AC electrical power, such as a battery powered pellet heater.

In order to provide a pellet heater untethered to an AC power source, it may be advantageous to reduce the power required to convey solid pellet fuel to the heater burn pot. Accordingly, there is a need also for a pellet heater that provides improved conveyance of fuel pellets from a storage hopper to a combustion area, such as a burn pot by reducing the power required to convey a given mass of pellet to a burn pot, and to power a pellet heater in general.

Known pellet heaters utilize a single speed auger motor and short operation duration motor to convey solid fuel pellets to a burn pot, or alternatively, to an exit for replacement or repair. The single speed and/or short duration operation auger motor may take a fairly long time to empty a full pellet hopper. Accordingly, there is a need also for a pellet heater that improves the ease with which a new flavor of pellet can replace an existing flavor of pellet stored in the hopper.

Known pellet heaters also provide radiant heat only which limits the area that is heated. Accordingly, there is a need for a pellet heater that employs a forced air system to distributed heated air in a relatively large area around the heater.

Outdoor spaces are often lighted and attract insects that are annoyances to a gathering of people. Even in daylight hours, insects may be attracted to an outdoor space. Accordingly, this is a need for a pellet heater that is configured to distribute insect repellant, such as citronella, along with the distribution of heated air. Indeed, such pellet heaters may also be used to distribute scented heated air to provide a pleasant atmosphere for entertaining. Accordingly, there is also a need for a pellet heater that is configured to distribute aromatic agents along with the distribution of heated air.

Known pellet heaters require a system for removing the ash that remains after combusting solid pellet fuel. Existing ash removal systems can be messy and cause ash to spill on the ground or underlying surface. Accordingly, there is a need also for a pellet heater that improves the ability and speed of clearing pellet ash from the heater for cleaning purposes.

OBJECTS OF THE INVENTION

Accordingly, it is an object of some, but not necessarily all embodiments of the present invention to provide a pellet heater that is untethered to a continuous supply of AC electrical power.

It is also an object of some but not necessarily all embodiments of the present invention to provide a pellet heater that provides improved conveyance of fuel pellets from a storage hopper to a combustion area, such as a burn pot, by including multiple auger blades for convey of solid fuel.

It is also an object of some but not necessarily all embodiments of the present invention to provide a pellet heater that improves the ease with which a new flavor of pellet can replace an existing flavor of pellet stored in the heater hopper by providing for high-speed or longer duration auger motor operation for a pellet replacement procedure.

It is also an object of some but not necessarily all embodiments of the present invention to provide a pellet heater that improves the ability to clear all pellets from the heater for cleaning and/or replacement purposes by providing for high-speed or longer auger motor operation for a pellet clean-out procedure.

It is another object of some, but not necessarily all embodiments of the present invention to provide a pellet heater that reduces the power required to convey a given mass of pellet to a burn pot, as well as reduces the electrical power requirements, in general, of a pellet heater, by providing a dual auger blade system that conveys solid fuel to a central burn pot location from right and left storage locations.

It is another object of some, but not necessarily all embodiments of the present invention to provide a pellet heater that employs a plurality of blowers and associated heat vents in a forced air system to distributed heated air in a relatively large area around the heater.

It is another object of some, but not necessarily all embodiments of the present invention to provide a pellet heater that is configured to distribute insect repellant, such as citronella, and/or other pleasant aromatic agents, along with the distribution of heated air.

In is another object of the some, but not necessarily all embodiments of the present invention to provide a pellet heater that improves upon the ash removal process by improving upon the burn pot removable base design.

SUMMARY OF EMBODIMENTS OF THE INVENTION

Responsive to the foregoing challenges, Applicant has developed an innovative pellet fueled heater, comprising: a base housing; an intake housing disposed within the base housing; one or more blowers disposed within the base housing, said one or more blowers connected to the intake housing; one or more heat vents provided in the base housing; a burn pot housing disposed within the intake housing; a burn pot disposed within the burn pot housing; a solid fuel hopper disposed within the base housing; and an auger system disposed within the base housing between the burn pot and solid fuel hopper.

Applicant has further developed an innovative pellet fueled heater, comprising: a base housing; an intake housing disposed within the base housing; one or more blowers disposed within the base housing, said one or more blowers connected to the intake housing; one or more heat vents provided in the base housing; a burn pot housing disposed within the intake housing; a burn pot disposed within the burn pot housing; a solid fuel hopper disposed within the base housing; an auger system disposed within the base housing between the burn pot and solid fuel hopper; an outer tube sealed to and extending away from the intake housing through an opening in an upper part of the base housing; and an inner tube disposed within the outer tube, said inner tube sealed to and extending away from the burn pot housing, wherein an outer tube passage is defined between the outer tube and the inner tube, said outer tube passage communicating with an interior of the intake housing, and wherein an inner tube passage is defined by an interior of the inner tube, said inner tube passage communicating with an interior of the burn pot housing.

Applicant has still further developed an innovative outdoor solid fuel, gas fuel, or electric powered heater, comprising: a base housing having a bottom wall and four side walls connected in a rectangular shape extending upward from the bottom wall; an intake housing disposed within the base housing; a first blower disposed within the base housing proximal to a first one of said four side walls and connected to the intake housing; a second blower disposed within the base housing proximal to a second one of said four side walls and connected to the intake housing; a first heat vent provided in the base housing proximal to said first blower; a second heat vent provided in the base housing proximal to said second blower; an inner housing disposed within the intake housing; a solid fuel, gas fuel, or electric powered heat source disposed within the inner housing; an outer tube sealed to and extending away from the intake housing through an opening in the base housing; and an inner tube disposed within the outer tube, said inner tube sealed to and extending away from the inner housing, wherein an outer tube passage is defined between the outer tube and the inner tube, said outer tube passage communicating with an interior of the intake housing, and wherein an inner tube passage is defined by an interior of the inner tube, said inner tube passage communicating with an interior of the inner housing.

Applicant has still further developed an innovative solid fuel heater, comprising: a base housing; an intake housing disposed within the base housing; one or more blowers disposed within the base housing, said one or more blowers connected to the intake housing; one or more heat vents provided in the base housing; a burn pot housing disposed within the intake housing; a burn pot disposed within the burn pot housing; a solid fuel hopper disposed within the base housing; and a solid fuel supply mechanism disposed within the base housing between the burn pot and solid fuel hopper, wherein each one of said one or more blowers is proximal to and associated with a distinct one of said one or more heat vents.

Applicant has still further developed an innovative solid fuel heater, comprising: a base housing having a bottom wall and four side walls connected in a rectangular shape extending upward from the bottom wall; an intake housing disposed within the base housing; a first blower disposed within the base housing proximal to a first one of said four side walls and connected to the intake housing; a second blower disposed within the base housing proximal to a second one of said four side walls and connected to the intake housing; a first heat vent provided in the base housing proximal to said first blower; a second heat vent provided in the base housing proximal to said second blower; a burn pot housing disposed within the intake housing; a burn pot disposed within the burn pot housing; a solid fuel hopper disposed within the base housing; and a solid fuel supply mechanism disposed within the base housing between the burn pot and solid fuel hopper.

Applicant has still further developed an innovative solid fuel heater, comprising: a base housing; an intake housing disposed within the base housing; one or more blowers disposed within the base housing, said one or more blowers connected to the intake housing; one or more heat vents provided in the base housing; a burn pot housing disposed within the intake housing; a burn pot disposed within the burn pot housing; a solid fuel hopper disposed within the base housing; a solid fuel supply mechanism disposed within the base housing between the burn pot and solid fuel hopper; an outer tube extending away from the intake housing through an opening in the base housing; and an inner tube disposed within the outer tube, said inner tube extending away from the burn pot housing, wherein each one of said one or more blowers is proximal to and associated with a distinct one of said one or more heat vents, wherein an outer tube passage is defined between the outer tube and the inner tube, said outer tube passage communicating with an interior of the intake housing, and wherein an inner tube passage is defined by an interior of the inner tube, said inner tube passage communicating with an interior of the burn pot housing.

It is to be understood that both the foregoing general description and the following detailed description are exemplary and explanatory only and are not restrictive of the invention as claimed.

BRIEF DESCRIPTION OF THE DRAWINGS

In order to assist the understanding of this invention, reference will now be made to the appended drawings, in which like reference characters refer to like elements. The drawings are exemplary only and should not be construed as limiting the invention.

DETAILED DESCRIPTION OF EMBODIMENTS OF THE INVENTION

Figure 1:
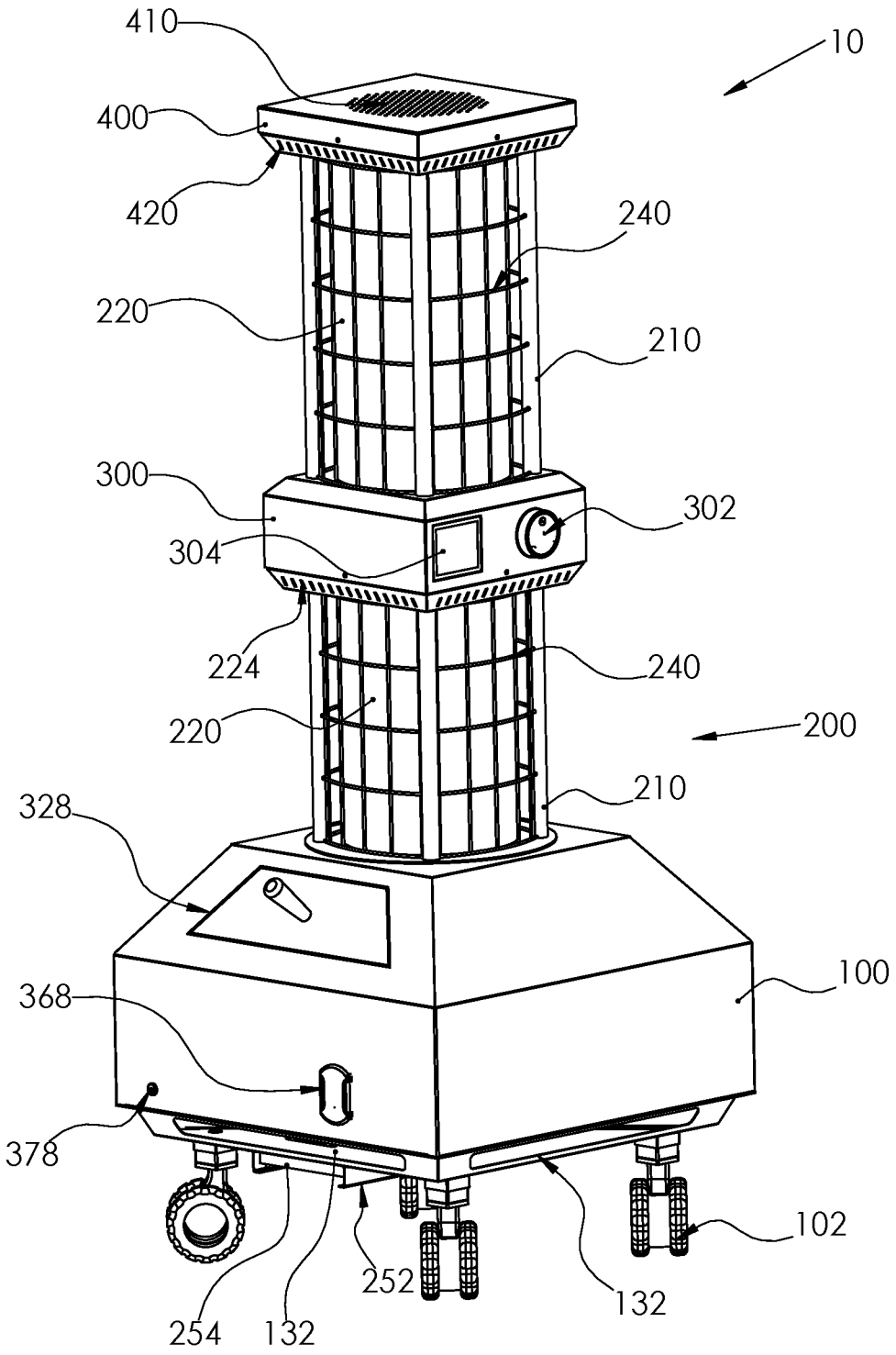
FIG. 1 is a perspective view of a pellet heater in accordance with embodiments of the invention.
Figure 2:
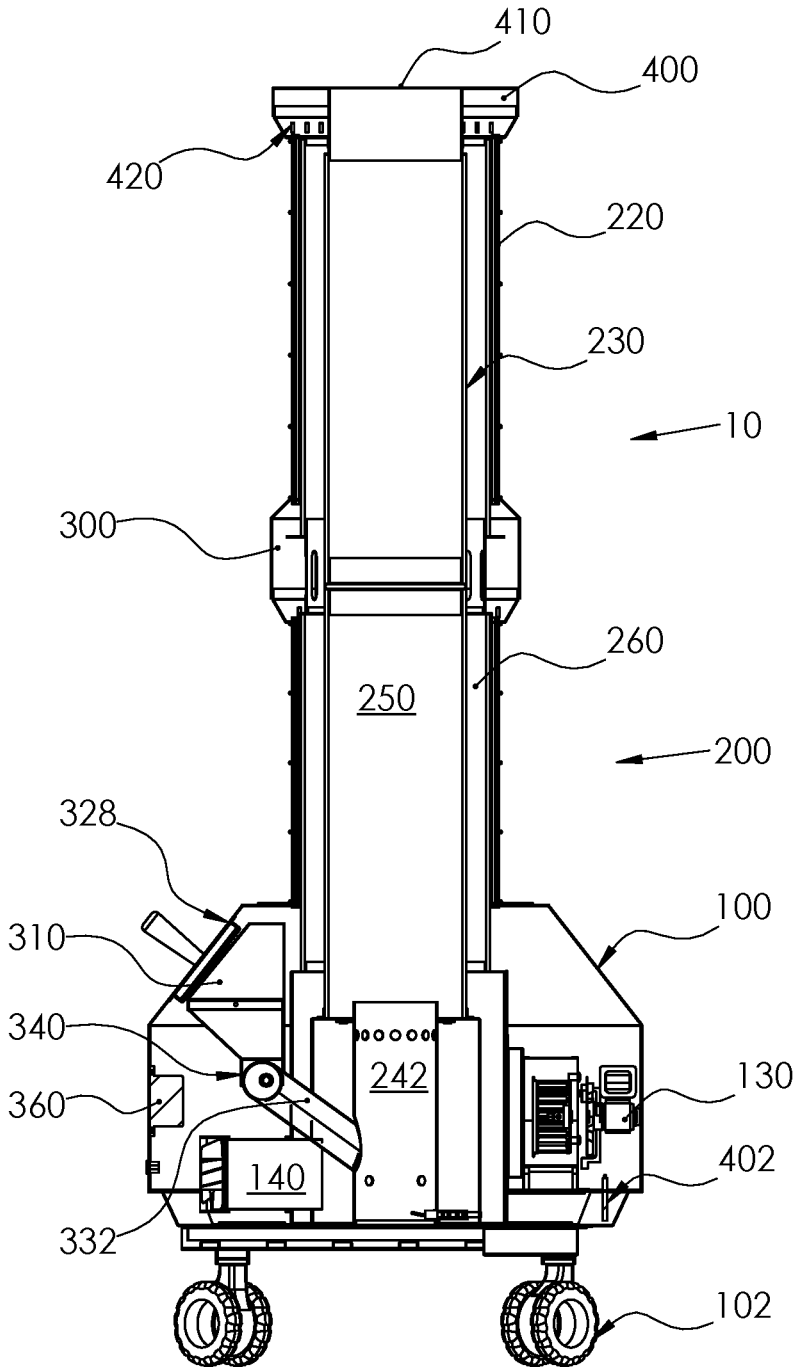
FIG. 2 is a cross-sectional side view of a pellet heater in accordance with embodiments of the invention.

Reference will now be made in detail to embodiments of the present invention, examples of which are illustrated in the accompanying drawings. With reference to FIGS. 1-2, a pellet heater 10 may include a lower base unit, including a base housing 100, and a chimney structure 200. The base housing 100 may be provided with caster wheels 102 and wheel locks. With reference to FIGS. 1-2 and 7-8, preferably the base housing 100 may have a bottom wall and four side walls connected in a rectangular shape extending upward from the bottom wall. Each of the four side walls of the base housing 100 may have a rectangular bottom portion that transitions to an inwardly slanted trapezoidal upper portion. In addition, an inwardly canted recessed side wall portion may be included as the lower most portion of each of the four side walls, and an elongated vent opening 132 may extend along the majority of the width of each side wall in each recessed side wall portion. The top wall of the base housing 100 may include a large central opening configured to securely receive the chimney structure 200 that extends upward and away from the base housing. The size, shape, and design of the base housing 100 may be varied without departing from the intended scope of the invention. For example, in alternative embodiments, the base housing may have a circular or oval footprint instead of a rectangular footprint as shown.

With reference to FIGS. 1-6, the chimney structure 200 may include a plurality of elongated upwardly extending vertical tubes 210 connected together by a lattice or cage of smaller diameter protective supports 240. The vertical tubes 210 may be hollow to conceal internal wiring running between a readout panel controller 304 and the base housing 100. The combination of the vertical tubes 210 and protective supports 240 may support a center housing 300 and an upper cap 400. The vertical tubes 210 and the protective supports 240 may also surround and protect an outer tube 220 that extends from an intake housing 262 disposed within the base housing 100 at a bottom end to the upper cap 400 at a top end. The outer tube 220 may be made of any suitable heat tolerant material, but preferably of transparent or translucent heat resistant glass or plastic. Preferably the outer tube 220 is not only supported by the intake housing 262, but is connected thereto and sealed thereto. Optional electrically powered lighting may be supported by the outer tube 220 and/or the combination of the vertical tubes 210 and protective supports 240. An inner tube 230 may be disposed within the outer tube 220 such that an outer tube passage 260 is defined between the outer tube and the inner tube. In turn, an inner tube passage 250 may be defined by an interior of the inner tube 230. The inner tube 230 may extend from an inner housing or burn pot housing 245 disposed within the intake housing 262 at a bottom end to the upper cap 400 at a top end. The inner tube 230 also may be made of any suitable heat tolerant material, but preferably of transparent or translucent heat resistant glass or plastic. Preferably the inner tube 230 is not only supported by the inner housing or burn pot housing 245, but is connected thereto and sealed thereto.

Figure 5:
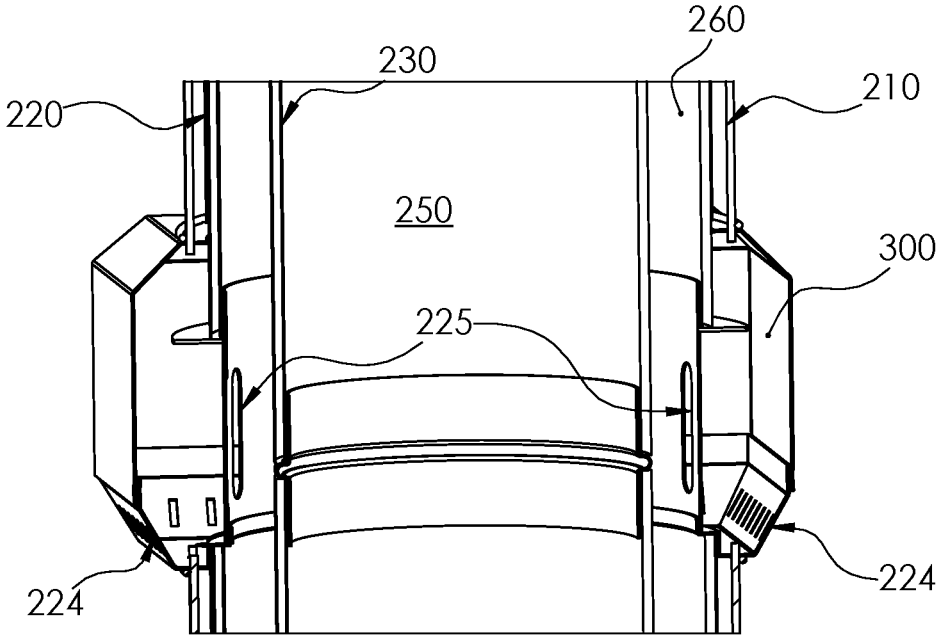
FIG. 5 is a cross-sectional side perspective view of a pellet heater chimney structure and center housing in accordance with embodiments of the invention.
Figure 6:
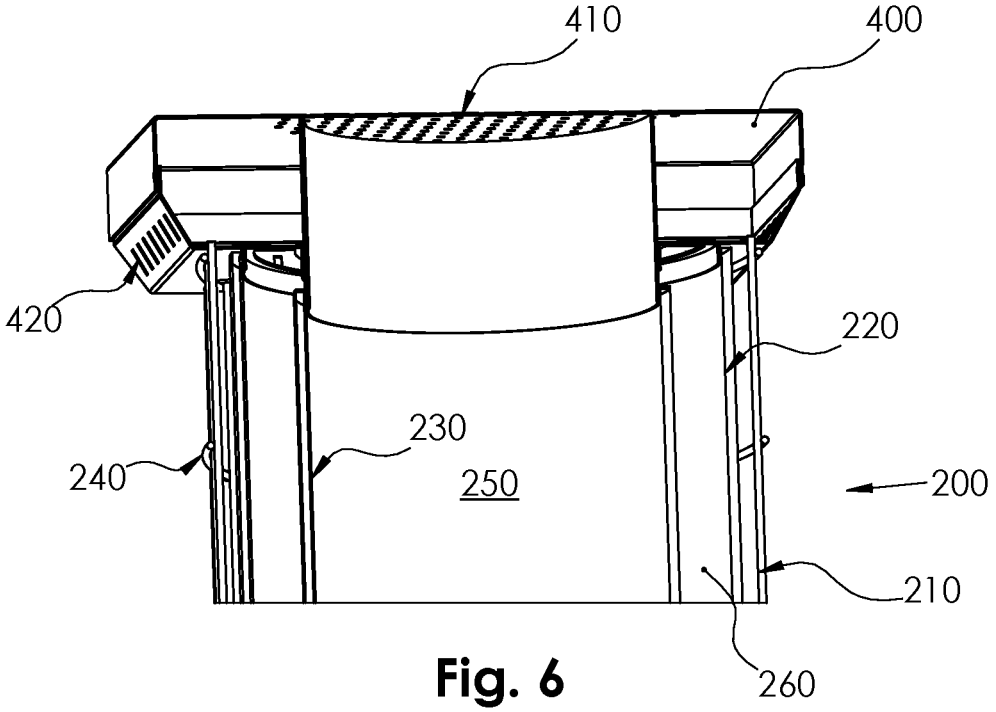
FIG. 6 is a cross-sectional side perspective view of a pellet heater chimney structure and upper cap in accordance with embodiments of the invention.

With reference to FIG. 5, the center housing 300 may be hollow and include an array of mid-station inlet vents 224 on each of its four sides. The center housing 300 may be closely fitted to the outer tube 220, or even sealed thereto. Mid-station outer tube openings 225 may be provided in the wall of the outer tube 220. With reference to FIG. 6, the upper cap 400 may be hollow and supported by, and preferably connected to, one or more of the vertical tubes 210, protective supports 240, and the outer tube 220. The upper cap 400 may include an array of upper cap air intake vents 420 on each of its four sides and a centrally located exhaust vent 410. Preferably a sleeve extends between the exhaust vent 410 and the inner tube 230 and provides a seal between the foregoing. The combination of the inner tube 230 and the sleeve work together to isolate the outer tube passage 260 from the inner tube passage 250. As a result, the inner tube passage 250 communicates exclusively, or nearly exclusively, with the exhaust vent 410, while the outer tube passage 260 communicates exclusively, or nearly exclusively, with the upper cap intake vents 420 and mid-station inlet vents 224 in terms of fresh air movement into the heater 10.

With reference to FIGS. 1-8, the outer tube passage 260 may communicate with an interior of the intake housing 262. Three of the four side walls of the intake housing 262 may have an electrically powered blower 130 (preferably a centrifugal blower) connected thereto. Each blower 130 may be electrically connected to the battery pack 372 and/or the AC receptacle 378, as well as the readout panel/controller 304. The intake end of each blower 130 may be sealed to the intake housing 262, and the exhaust end of each blower may direct air towards an associated and proximal heat vent 132 provided in the base housing 100. The burn pot housing 245 may isolate the burn pot 242 from the interior of the intake housing 262 so that the hot exhaust fumes from the burn pot pass exclusively upward into the inner tube passage 250 and out of the exhaust vent 410 provided in the upper cap 400. These hot exhaust fumes may heat the inner tube 230. When the blowers 130 are engaged, fresh air may be drawn through the upper cap air intakes 420 in the upper cap 400 and through the mid-station air inlet vents 224 into the outer tube passage 260 where it is heated by the inner tube 230. The incoming fresh air is further heated in the intake housing 262 by virtue of heat transfer through the walls of the burn pot housing 245. The heated fresh air is then drawn through the blowers 130 and directed through the base housing 100 to the heat vents 132. Preferably the blowers 130 are of sufficient strength to establish a heated zone of 10 to 15 feet in diameter. The blowers 130 or a portion of the base housing 100 between the blowers and the heat vents 132 may each include a location at which a liquid or solid aromatic dispensing unit may be provided. The aromatic dispensing unit may be the "plug-in" type and may be used to introduce scents, including insect repellant, such as citronella, into the stream of heated air exiting the base housing 100.

While the preferred heat source is a solid pellet fuel burn pot, it is appreciated that one of ordinary skill in the art could alternatively use a different solid fuel, gas fuel, or electric powered, heat source. However, with respect to the preferred pellet fueled heat source, and with reference to FIGS. 1-4 and 7-8, one side wall of the base housing 100 may include an openable pellet hopper door 328, a battery compartment cover 368, and an alternating current (AC) receptacle 378. The battery compartment cover 368 may conceal a battery compartment 370 containing a removeable direct current (DC) battery pack 372. The battery compartment 370 may also house an optional battery charger (not shown) that is connected to the AC receptacle 378. The battery compartment 370 and battery pack 372 may be electrically connected to a readout panel/controller 304 which in turn is operatively connected to a control knob 302. The readout panel/controller 304 and control knob 302 may be provided on or in the center housing 300 provided as part of the chimney structure 200 above the base housing 100. The readout panel/controller 304 may be wirelessly or plug-in connected to various electrical components in the heater, such as the battery pack 372, the AC receptacle 378, an auger motor 348, an intake fan assembly 140, the blowers 130, a Resistance Temperature Detector (RTD) 402, and a spark generator 360, which are discussed in more detail below.

With continued reference to FIGS. 1-4 and 7-8, the pellet hopper 310 may be provided within the base housing 100 adjacent to the hopper door 328. The pellet hopper 310 may taper inwardly from top to bottom to promote the flow of pellets in a downward direction under the influence of gravity. An example of the inward taper of the pellet hopper 310 is readily visible from FIG. 2. The hopper 310 may be used to store different types of solid fuel, preferably solid pellet fuel. The bottom end of the hopper 310 may be open so that fuel pellets may drop from the hopper into a dual blade auger 340 disposed within a tube-shaped auger housing 350. The auger 340 may be configured to convey fuel pellets inwardly from opposing (left side and right side) ends of the hopper 310 to a pellet feed tube 332 located near or at the center of the hopper. The pellet feed tube 332 may be inclined downward and inward (i.e., towards the center of the base housing 100) through the walls of the intake housing 262 and the burn pot housing 245 to the burn pot 242. The burn pot 242 may include a number of openings 244 to provide air flow from the interior of the burn pot housing 245 housing to the interior of the burn pot 242.

With reference to FIGS. 2-4, 7-8 and 10, the auger 340 may have a left auger blade 342 and a right auger blade 344 set with opposing blade angles or pitches. The respective left and right auger blades, 342 and 344, may be configured to convey pellets inwardly from opposing (left side and right side) ends of the hopper 310 to the pellet feed tube 332 located near or at the center of the hopper. More specifically, the left auger blade 342 and the right auger blade 344 may have a colinear axis of rotation, and the two auger blades convey solid fuel pellets in different directions, preferably in opposite directions taken relative to a common reference line. The left and right auger blades, 342 and 344, may be connected to a single auger shaft 345, which in turn connects the two auger blades. An auger center piece 343 may have one or more pins having a central axis extending away from the auger shaft in an orthogonal direction. The auger 340 may be supported by one or more auger bearings 346 and be partially encased by the auger housing 350 defining a passage extending between the bottom end of the hopper 310 and the pellet feed tube 332.

The auger motor 348 may drive the auger 340 at various predetermined speeds and/or for various durations under the control of the readout panel/controller 304 (shown in FIG. 1). The auger motor 348 may drive the auger 340 at one or more predetermined speeds and/or predetermined durations to provide a desired amount of fuel based on measured temperatures. Temperature measurements may be taken using the RTD 402 positioned as needed in the base housing 100 and/or the chimney structure 200. By using the dual auger 340, less power may be consumed by the auger motor 348 to convey a given mass of pellet fuel because the pellets are nearer the feed tube 332 than is the case with alternative solid fuel supply mechanisms, and because the pellets only need to be conveyed a short distance from opposing sides of the hopper to a central feed tube. This design also may be used to conduct a pellet replacement operation and/or a pellet hopper cleaning operation using the auger 340 system. By removing the burn pot base 254 (discussed below) solid fuel pellets may be conveyed from the hopper 310 through the pellet feed tube 332 and out of the bottom of the burn pot 242 to a receptacle (not shown). Still further, under the control of the readout panel/controller 304, the auger motor 348 may be able to run continuously and/or at a relatively higher speed to quickly evacuate all pellets from the pellet hopper/compartment(s) for pellet clean-out operations and/or pellet replacement operations as compared with the rotational duration and/or speed of the auger motor for normal burn operation. For example, such clean-out operations may result from running the auger motor 348 continuously at least two to three times the speed than as for burn operation, or even tens of RPMs faster than for burn operation. Preferably, the clean-out operation speed of the auger motor 348 is continuous running in the range of 1.5 to 4 RPMs greater than as for heater burn operation. In some embodiments, the higher clean-out speed may be selectively controlled by the user using the readout panel/controller 304 or some other control device.

With reference to FIGS. 1-3 and 7-8, the burn pot 242 may be connected to a fan assembly 140 disposed within the base housing 100. The fan assembly 140 may be used to draw air through one of the heat vents 132 and thereafter direct the air to the burn pot housing 245 and the burn pot 242. A Resistance Temperature Detector (RTD) 402 also may be mounted within the interior of the base housing 100.

With reference to FIGS. 1, 3, 8 and 9, the base housing may include two opposing flanges, rails or tracks 252 configured to slidingly receive a removeable burn pot base 254. The flanges 252 may be provided so that the burn pot base 254 may slide forward and away from the base housing 100. The burn pot base 254 may have a forward portion with a raised surface that is essentially flush with the bottom of the base housing 100, and a rear portion with a depression that is configured to collect ash as the burn pot base is pulled forward. Additionally, the depression may be used to hold aromatics, such as citronella. The burn pot base 254 may be removed for solid fuel ash clean-out, or unburned solid fuel clean-out/replacement. During a pellet removal process, the auger 340 may be run at high speed or longer duration under the control of the readout panel/controller 304. Specifically, a method of solid fuel clean-out operation may involve the steps of providing solid fuel in the hopper 310, removing the burn pot base 254, and rotating the auger blades at a longer duration and/or higher speed than is used for heater burn operation in order to convey solid fuel from the hopper through the open bottom of the burn pot 242 for the clean-out operation.

Figure 3:
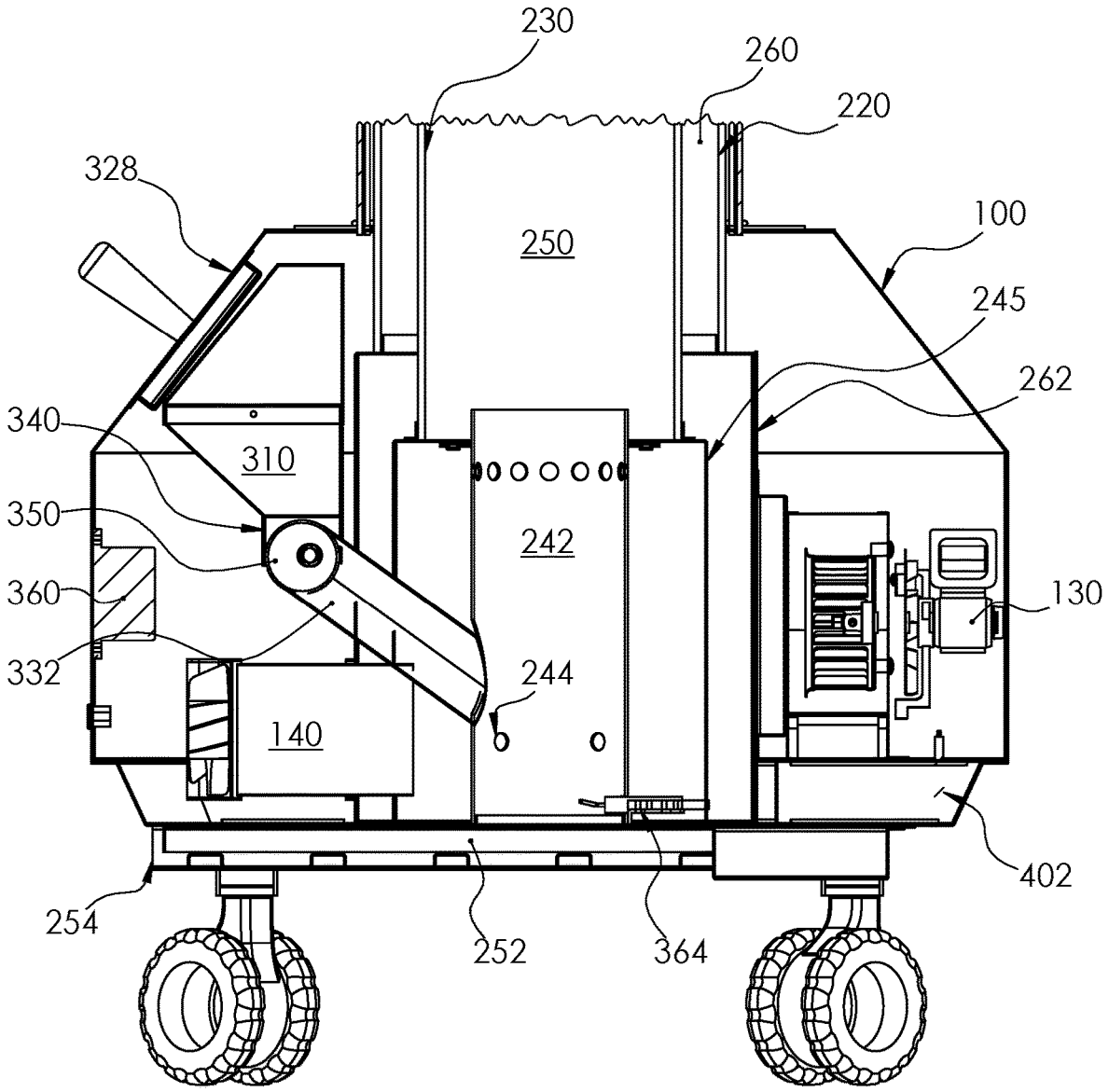
FIG. 3 is a cross-sectional side plan view of a pellet heater base unit in accordance with embodiments of the invention.
Figure 4:
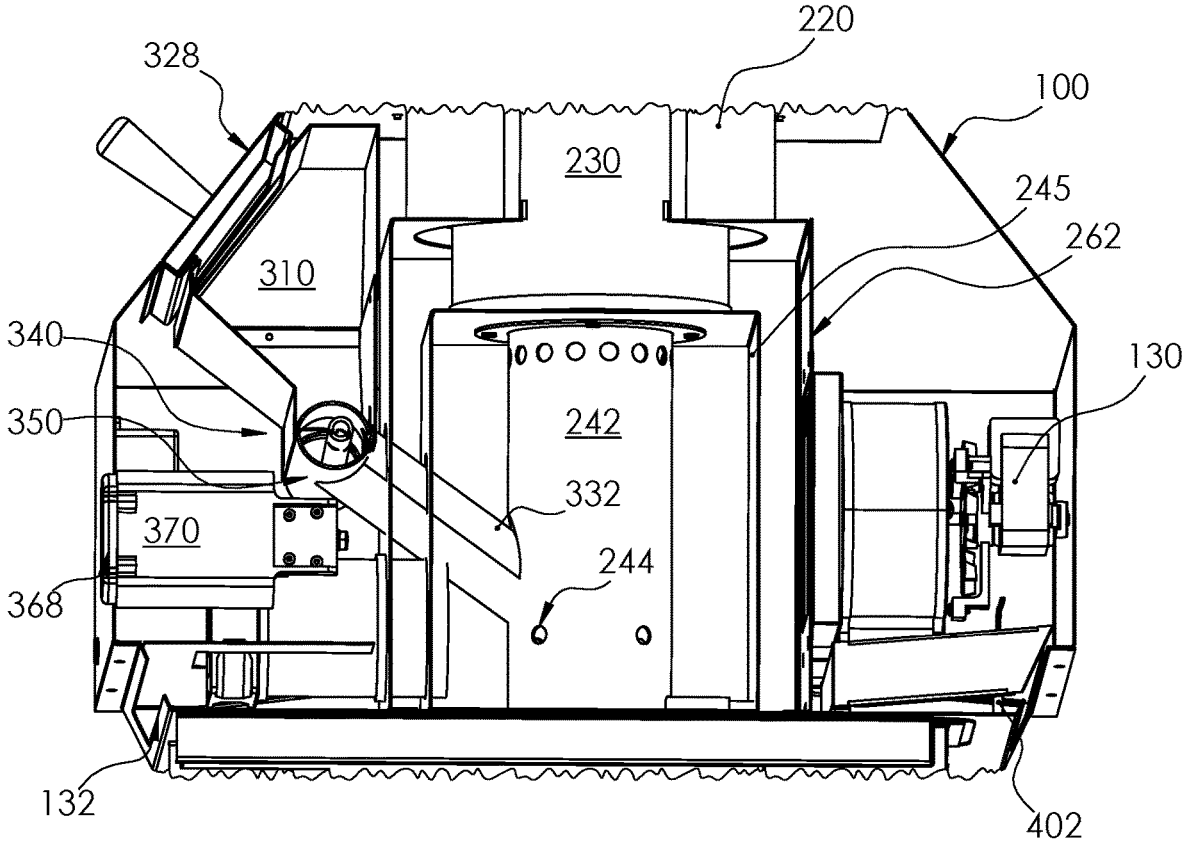
FIG. 4 is a cross-sectional side perspective view of a pellet heater base unit in accordance with embodiments of the invention.
Figure 7:
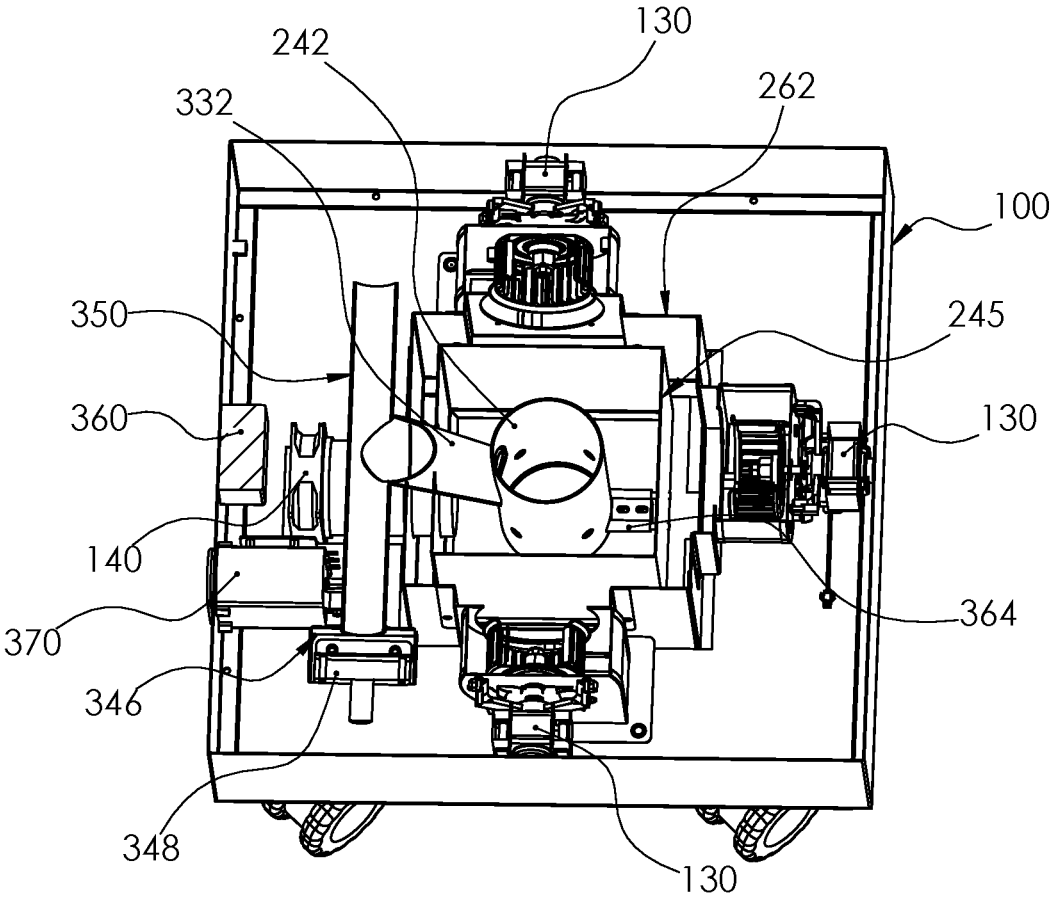
FIG. 7 is a cross-sectional top perspective view of a pellet heater base unit in accordance with embodiments of the invention.
Figure 8:
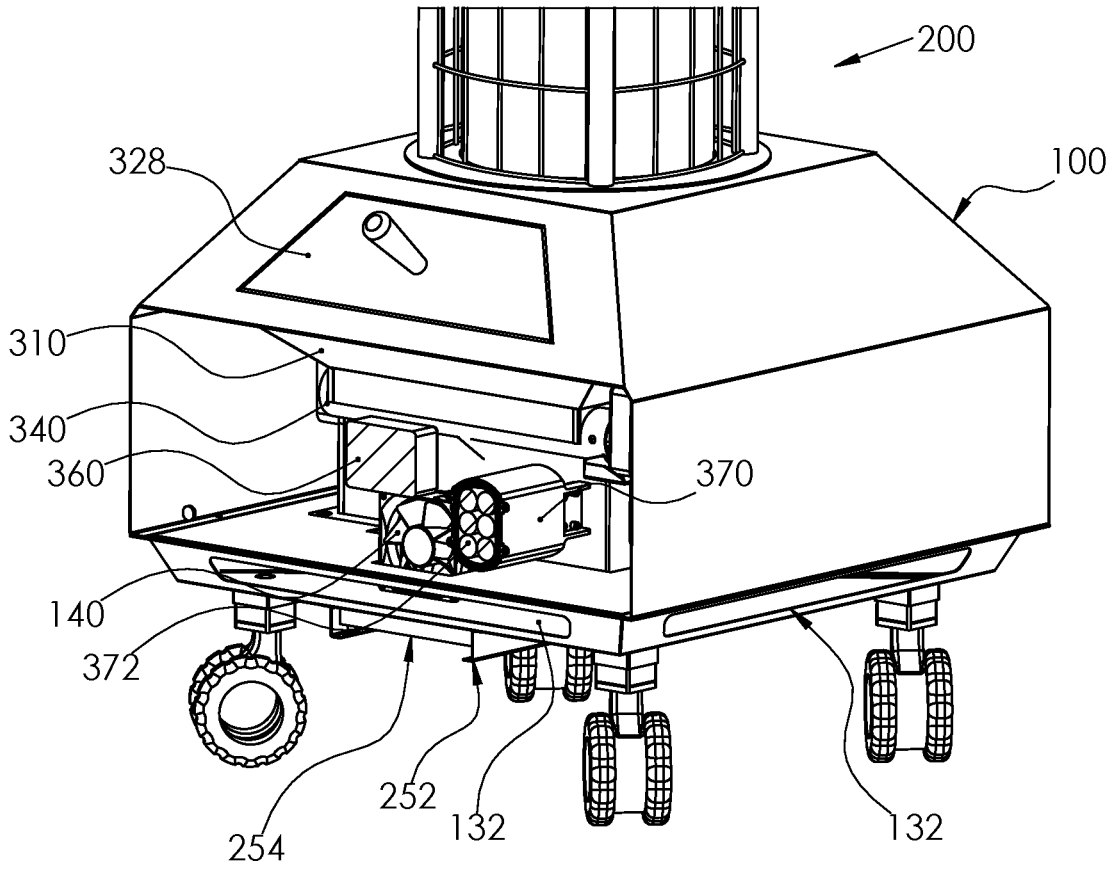
FIG. 8 is a cross-sectional side perspective view of a pellet heater base unit in accordance with embodiments of the invention.
Figure 9:
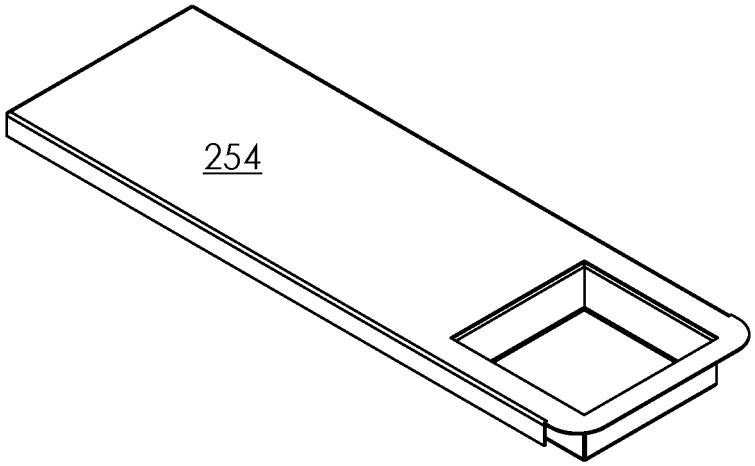
FIG. 9 is a perspective view of a burn pot base in accordance with embodiments of the invention.
Figure 10:
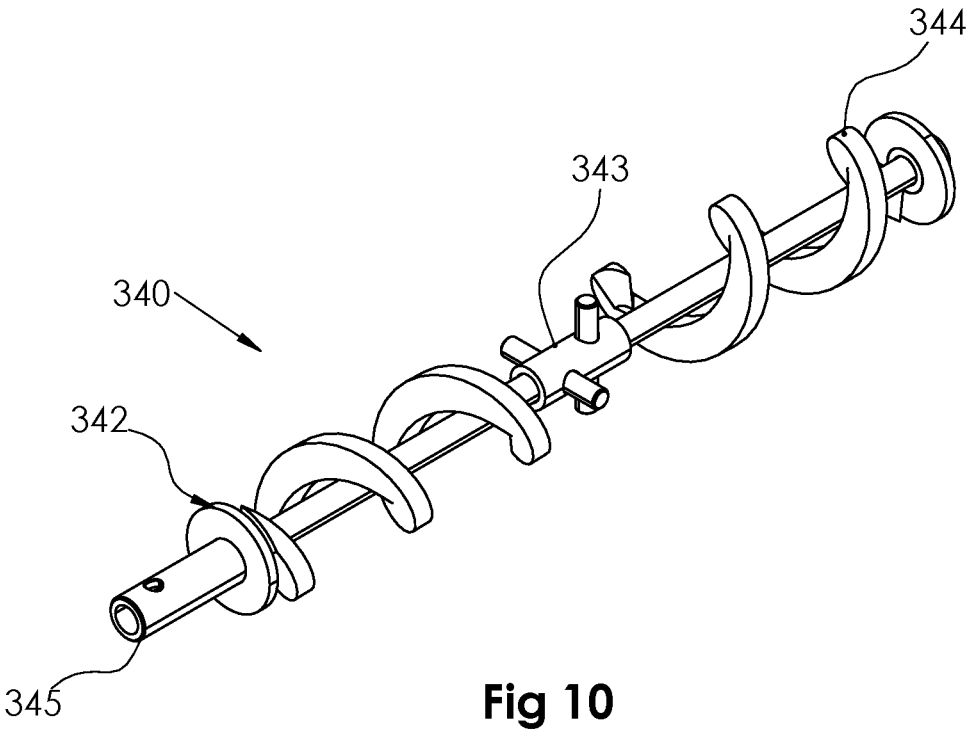
FIG. 10 is a perspective view of a dual auger blade and auger shaft assembly in accordance with embodiments of the invention.

With reference to FIGS. 3 and 7, an AC and/or DC powered dual ignitor or electrode 364 may extend through the walls of the burn pot 242 into the interior of the burn pot. The electrode 364 may include two tips separated by an air gap across which a continuous spark may be provided to ignite pellets in the burn pot 242. The electrode 364 may be retained in place using a pressure fit with the burn pot 242 or other fastening means. The dual igniter 364 may include first and second electrodes that may each include a metallic tip extending away from a surrounding ceramic insulator. Each metallic tip may be comprised of a circular cross-sectional stiff solid wire made of nickel-chromium alloy having a diameter of 1 to 4 millimeters, and more preferably 1.5 to 3.5 millimeters. Each metallic tip may include a bend portion that directs the end of the metallic tip towards the other metallic tip in the pair. The pair of metallic tips may be bent or otherwise separated by an air gap across which a discharge spark may be provided continuously to ignite pellets in the burn pot 242. Preferably the air gap may be 4 to 6 millimeters, or more preferably 4.5 to 5.5 millimeters. An electrical connector, such as conductive wire, may connect the electrodes 364 to a spark generator 360 that is in electrical communication with, and powered by, the battery 372. Preferably, the spark generator 360 may be provided in close proximity to the battery 372. The spark generator 360 may include a booster coil and a Darlington transistor and have a power requirement of 12V/3 A to provide a continuous spark. By "continuous" spark, it is meant to describe a spark that is not a "pulse" spark that jumps the air gap quickly and lasts less than 1 second, but instead a constant arc of spark lasting greater than 1 second, and in some instances lasting constantly for up to 15-20 minutes to create combustion of solid fuel. At heater start up, the spark generator 360 preferably creates a continuous spark for about 4 minutes or more to insure combustion.

Figure 11:
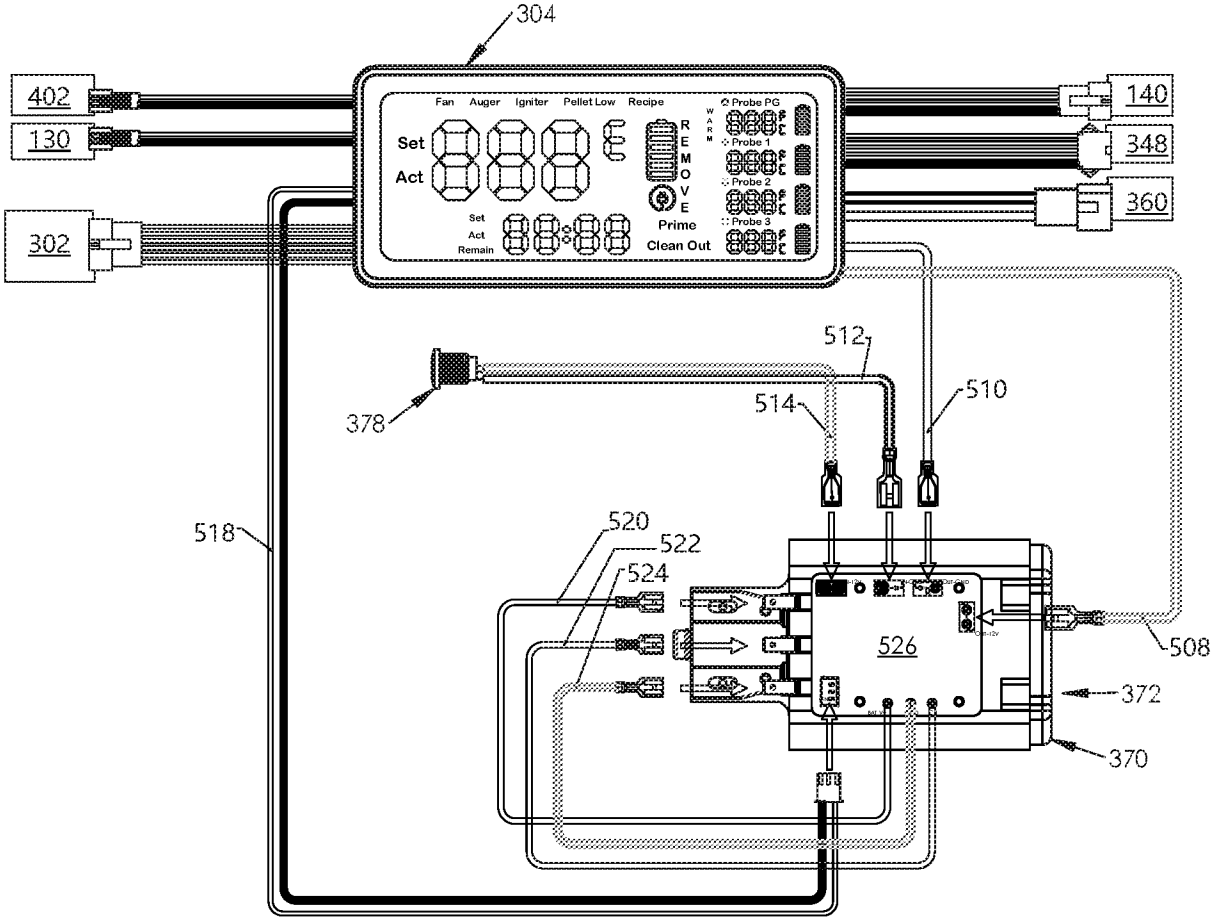
FIG. 11 is a schematic diagram of a pellet heater electrical system in accordance with embodiments of the invention.

With reference to FIG. 11, the readout panel/controller 304 may be used to control the operation of the fan assembly 140, the operation of the blowers 130, the operation of the auger 340, and/or the operation of the spark generator 360 to provide a selective level of pellet combustion and heat generation in the burn pot 242. The controller 304 may use a feed-back loop including one or more of the RTDs 402 to provide a selected level of heat. The battery 372 may be of sufficient amperage and/or wattage to provide several hours of operation in terms of power for the auger 340, the fan assembly 140, the blowers 130, and the spark generator 360.

While the heater 10 may be powered by an alternating current (AC) power supply in some embodiments, in a preferred embodiment, the battery pack 372 powers the device. The battery pack 372 may power all onboard electrical components of the heater 10, including without limitation, the readout panel/power supply controller 304, the temperature sensor 402, the fan assembly 140, the blowers 130, the auger motor 348, and the spark generator 360. The battery pack 372 and battery compartment 370 may be electrically connected via a positive battery output (12V+) 520, a negative or ground battery output (12V−) 522, and a battery charge connection 524 to a distribution board 526. In turn, the distribution board 526 may be electrically connected to a main positive output (12V+) 508, a main negative or ground output (12V−) 510, an AC adapter negative or ground input (12V−) 512, and an AC adapter positive input (12V+) 514. The AC inputs 512 and 514 may be connected to an AC recharging receptacle adapted to connect to a conventional AC wall socket plug (not shown). In a preferred embodiment, the battery pack may include six (6) lithium-ion cells that provide 5 Ah/8 A output at a maximum/12V. The battery pack 372 may be of sufficient amperage and/or wattage to provide several or more hours of heater operation in terms of power for the RTD 402, the controller 304, the auger motor 348, the fan assembly 140, the blowers 130, and the spark generator 360.

As will be understood by those skilled in the art, the invention may be embodied in other specific forms without departing from the spirit or essential characteristics thereof. The elements described above are provided as illustrative examples for implementing the invention. One skilled in the art will recognize that many other implementations are possible without departing from the present invention as recited in the claims. Accordingly, the disclosure of the present invention is intended to be illustrative, but not limiting, of the scope of the invention. It is intended that the present invention cover all such modifications and variations of the invention, provided they come within the scope of the appended claims and their equivalents.

What is claimed:

1. A pellet fuel or solid fuel heater, comprising:
- a base structure;
- an intake housing;
- one or more blowers disposed within the base housing, said one or more blowers connected to the intake housing;
- one or more heat vents provided in the base housing;
- a burn pot housing disposed within the intake housing;
- a burn pot disposed within the burn pot housing;
- a pellet fuel or solid fuel hopper disposed within the base housing; and
- an auger system disposed within the base housing between the burn pot and solid fuel hopper,
- wherein said one or more blowers are configured to draw fresh air through said intake housing and direct the fresh air to the one or more heat vents.

2. The pellet fuel or solid fuel heater of claim 1 further comprising:
- an outer tube sealed to and extending away from the intake housing through an opening in an upper part of the base structure; and
- an inner tube disposed within the outer tube, said inner tube sealed to and extending away from the burn pot housing,
- wherein an outer tube passage is defined between the outer tube and the inner tube, said outer tube passage communicating with an interior of the intake housing, and
- wherein an inner tube passage is defined by an interior of the inner tube, said inner tube passage communicating with an interior of the burn pot housing.

3. The pellet fuel or solid fuel heater of claim 2 further comprising:
- an upper cap connected to the outer tube and the inner tube, said upper cap having an upper cap exhaust vent and an upper cap air intake vent.

4. The pellet fuel or solid fuel heater of claim 3
- wherein the upper cap exhaust vent communicates with the inner tube passage, and
- wherein the upper cap air intake vent communicates with the outer tube passage.

5. The pellet fuel or solid fuel heater of claim 4, further comprising:
- an opening in the outer tube; and a center housing attached to the outer tube above the base housing and adjacent to the opening in the outer tube, said center housing having a mid-station inlet vent communicating with the outer tube passage through the opening in the outer tube.

6. The pellet fuel or solid fuel heater of claim 2, further comprising:

an opening in the outer tube; and a center housing attached to the outer tube above the base structure and adjacent to the opening in the outer tube, said center housing having a mid-station inlet vent communicating with the outer tube passage through the opening in the outer tube.

7. The pellet fuel or solid fuel heater of claim 2 wherein the outer tube is at least partially transparent or translucent and extends at least thirty (30) inches away from the base housing.

8. The pellet fuel or solid fuel heater of claim 1, further comprising a pellet feed tube extending from the auger system through the intake housing and through the burn pot housing to the burn pot.

9. The pellet fuel or solid fuel heater of claim 1, further comprising:

an intake fan assembly disposed within the base structure, said intake fan assembly including a duct extending through the intake housing to the interior of the burn pot housing.

10. The pellet fuel or solid fuel heater of claim 9, further comprising:

a battery pack disposed within the base structure, said battery pack electrically connected to the intake fan assembly, the auger system, and the one or more blowers.

11. The pellet fuel or solid fuel heater of claim 10, further comprising:

a readout panel/controller attached to the pellet fuel or solid fuel heater and electrically connected to the battery pack.

12. The pellet fuel or solid fuel heater of claim 11, further comprising:

one or more electrically powered lights attached to the pellet fuel or solid fuel heater and electrically connected to the battery pack.

13. The pellet fuel or solid fuel heater of claim 1 wherein the auger system includes a first auger blade and a second auger blade, and wherein the first auger blade has a first pitch configured to convey solid fuel in a first direction and the second auger blade has a second pitch configured to convey solid fuel in a second direction, and wherein the first direction and the second direction are different directions.

14. The pellet fuel or solid fuel heater of claim 13 wherein the auger system includes an auger shaft connecting the first auger blade and the second auger blade.

15. The pellet fuel or solid fuel heater of claim 14 further comprising one or more pins disposed between the first auger blade and the second auger blade and connected to the auger shaft, said one or more pins having a central axis extending away from the auger shaft in an orthogonal direction.

16. The pellet fuel or solid fuel heater of claim 14 further comprising an auger motor operatively connected to the first auger blade and the second auger blade, wherein the auger motor is configured to rotate the first auger blade and second auger blade at a first speed for burn operation and a second higher speed for solid fuel clean out operation.

17. A pellet fuel or solid fuel heater, comprising:

a burn pot;

a solid fuel hopper;

an auger system disposed between the burn pot and solid fuel hopper;

an electrical power supply;

a spark generator electrically connected to the electrical power supply;

a first electrode electrically connected to the spark generator, said first electrode having a first metallic tip extending into the burn pot; and a second electrode electrically connected to the electrical ground, said second electrode having a second metallic tip extending into the burn pot, wherein a gap space is provided between the first metallic tip and the second metallic tip, and wherein the spark generator is configured to create a continuous spark in the gap space between the first metallic tip and the second metallic tip for a duration greater than 2 seconds.

18. The pellet fuel or solid fuel heater of claim 17 wherein the electrical power supply is a direct current (DC) power supply.

19. An outdoor solid fuel, gas fuel, or electric powered heater, comprising:

a base housing having side walls;

an intake housing disposed within the base housing;

a first blower disposed within the base housing proximal to a first one of said side walls and connected to the intake housing;

a second blower disposed within the base housing proximal to a second one of said side walls and connected to the intake housing;

a first heat vent provided in the base housing proximal to said first blower;

a second heat vent provided in the base housing proximal to said second blower;

an inner housing disposed within the intake housing;

a solid fuel, gas fuel, or electric powered heat source disposed within the inner housing;

an outer tube sealed to and extending away from the intake housing through an opening in the base housing; and an inner tube disposed within the outer tube, said inner tube sealed to and extending away from the inner housing, wherein an outer tube passage is defined between the outer tube and the inner tube, said outer tube passage communicating with an interior of the intake housing, wherein an inner tube passage is defined by an interior of the inner tube, said inner tube passage communicating with an interior of the inner housing, and wherein said first blower is configured to draw fresh air through said outer tube passage and direct the fresh air to the first heat vent.

* * * * *